US007258622B1

(12) United States Patent
Gaviria

(10) Patent No.: US 7,258,622 B1
(45) Date of Patent: Aug. 21, 2007

(54) GOLF TRAINING ASSEMBLY

(75) Inventor: Jaime Gaviria, Weston, FL (US)

(73) Assignee: Sof Golf, Inc., Weston, FL (US)

( * ) Notice: Subject to any disclaimer, the term of this patent is extended or adjusted under 35 U.S.C. 154(b) by 248 days.

(21) Appl. No.: 11/049,308

(22) Filed: Feb. 2, 2005

(51) Int. Cl.
*A63B 69/36* (2006.01)

(52) U.S. Cl. ..... 473/257; 473/219; 473/226

(58) Field of Classification Search ..... 473/257, 473/219, 226, 206, 231, 266
See application file for complete search history.

(56) References Cited

U.S. PATENT DOCUMENTS 5,143,376 A * 9/1992 Johnson ..... 473/228
5,310,188 A * 5/1994 Hernberg ..... 473/206
5,571,048 A * 11/1996 Kenney ..... 473/228
6,491,591 B1 * 12/2002 Schuster ..... 473/212
6,843,731 B1 * 1/2005 Oprandi ..... 473/238
6,881,156 B1 * 4/2005 Phillips ..... 473/228
2006/0040758 A1 * 2/2006 Coates ..... 473/221

* cited by examiner

*Primary Examiner*—Raleigh W. Chiu

(57) ABSTRACT

A training aid for monitoring and improving the orientation a golfer's hands while gripping the golf club as well as the golf club itself during the swing thereof, wherein the structure of the training aid is such as to allow it to be removably attached to the golf club and travel therewith during the swing without interfering with the normal path of the golf club during such swing. A base assembly comprises a housing removably connected to the club shaft and a reference assembly movably interconnected to the housing and positionable into an operative position. The reference assembly includes one or more legs disposable radially outward from the housing and into frontal alignment with a longitudinal axis of the golf club when in the operative position such that the one leg and/or an indicator structure thereon is readily observable as the club travels along the swing path.

5 Claims, 3 Drawing Sheets

GOLF TRAINING ASSEMBLY

BACKGROUND OF THE INVENTION

1. Field of the Invention

This invention is directed to a training aid capable of being removably secured to the shaft of a golf club and moveable therewith along the swing path during the swinging of the golf club. When so attached, a reference assembly of the training aid is disposable in an operative position at least partially defined by a radially outward extending portion oriented in frontal alignment with a longitudinal axis of the golf club. As such the reference assembly is observable by the golfer at various points along the swing path thereby allowing the golfer to determine whether or not the hands/grip of the golfer relative to the club head as well as the golf club itself is properly oriented during the golf swing.

2. Description of the Related Art

The game of golf has enjoyed increasing popularity over many years and is played by men, women and children of almost all ages. While appearing to be relatively simple, the act of striking a golf ball with a golf club in an effective manner for purposes of achieving a desirable score is surprisingly difficult. Except for an extremely limited number of individuals, the development of a correct or preferred golf swing is not a natural or easily accomplished procedure. Accomplishing a proper or "grooved" swing normally takes hours of practice and instruction from a knowledgeable individual. Even after many years of practice a seasoned golfer frequently encounters periods of time when his or her developed golf swing becomes flawed resulting in a less than desirable outcome in terms of obtaining a low or acceptable score.

When a golfer does not maintain proper orientation of the golf club along the swing path, the golf ball, when struck is often "sliced" or "hooked". While the reasons for striking the golf ball in this undesirable manner may vary significantly, one of the most common occurrences is that the golfer allows the club to twist or turn during some portion of the back swing or down swing and in some cases during the follow through segment of the swing path. As a result, the club face may be opened or closed which makes the golf ball "slice" or "hook". Accordingly, there is a significant advantage to a golfer being able to review or monitor the various portions of the swing path of the club in order to eliminate or significantly reduce the possibility of improperly orienting the golf club during the golf swing. While a conscientious golfer may spend hours practicing, as well as conducting exercises to improve one's posture, muscle control, etc., the imperfections in the golf swing may be unconsciously occurring, at least to the extent that the golfer does not realize that the swing path and the normally grooved swing of the golfer has changed.

In order to overcome problems of the type set forth above, several corrective or educational aids have been introduced into the game of golf. Such devices are structured and/or intended to be utilized in a manner which corrects the golf swing by removing the most harmful flaws therefrom. Such known or attempted training devices vary significantly in both structure and method of use and include, but are not limited to, gripping aids, harnesses, club restraining or guiding devices, as well as body restraints, slings, etc. While at least some of these devices may be considered at least minimally functional or operative for their intended purpose, many have been found to be ineffective or overly complex in their structure, application and practice.

One category of known golf training and/or practice devices involves a variety of different objects or structures which are attachable directly to the golf club, wherein the utilization thereof are intended to "train" a golfer into achieving the preferred or maximized "grooved" swing. However, one common problem associated with training devices intended for attachment to the golf club is the difficulty of golfers being able to perform or practice their typical or normal golf swing. More specifically, the structure, size, configuration, etc. of many conventional and/or known teaching and practice devices prevent a golfer from making the normal swing or a preferred or maximized swing during practice and/or actual play. As a result, once device is removed from the golf club, the golfer may very well revert to the flawed swing pattern which he or she has been trying to correct.

Therefore, there is a long and well recognized need in the sport of golf for a training aid which can efficiently aid a golfer in monitoring his or her golf swing. If and when developed, such a preferred golf training aid would preferably be of a significantly small, lightweight configuration and construction thereby enabling the preferred training aid to be removably secured to the golf club so as to travel therewith during a typical swing path as normally performed by the golfer. Further, such a preferred training aid would include specific structural and operative components which would enable a self-evaluation of the swing path by facilitating clear observation of the club during the various segments of the golfer's swing. Therefore, the golfer would be able to examine and review the position of the club as well as the hands and arms during various portions of the golf swing including the address, back swing, forward or down swing, as well as certain segments of the follow through. As such, a golfer would be able to self evaluate various segments of the swing path during the occurrence of the golf swing and be able to correct the position or orientation of the club if necessary. Hopefully the result would be an improved and eventual "grooving" of the golf swing resulting in significantly better scoring on a consistent basis.

SUMMARY OF THE INVENTION

The present invention is directed to a training aid intended for use by participants in the game of golf for purposes of reviewing, evaluating and if necessary, correcting one's golf swing. It is of course well recognized that those individuals who excel in the game of golf have, at least to a significant extent, established a proper grip and otherwise maximized the swing path of the various clubs within a set, such that the golfer's swing is said to be "grooved". As such, the golfer is able to strike the golf ball with an intended amount of force while controlling or maintaining intended path of the golf ball during flight.

However, even with professional and more accomplished amateur golfers, it is not uncommon for imperfections to unknowingly develop in an individual's golf swing. Such imperfections frequently result in loss of control of the flight of the golf ball, inaccurate golf shots and attendant poor scores. Accordingly, the training aid of the present invention is structured to facilitate a golfer being able to monitor, evaluate and thereafter correct the position of his or her hands relative to the club head as well as the golf swing itself, by determining if the club is properly oriented at various points along the swing path through which the golf club travels. Therefore, the training aid of the present invention is structured to be mounted on and travel with the golf club during the golf swing such that various segments of the swing path of the golf club may be monitored and evaluated, as set forth above. As such, the training aid of the present invention is dimensioned, configured and structured to eliminate the possibility of interfering with the intended swing path but which facilitates the review, evaluation and resulting correction of the golf swing and hand position as set forth above.

As set forth in greater detail hereinafter, the various preferred embodiments of the golf swing training aid of the present invention comprises a base assembly removably mounted on the golf club and structured to move therewith through the entire swing path. In order to not interfere with the normal swing typically used by any given golfer, the base assembly, including its various structural and operative components, is formed from a lightweight material such as plastic, fiberglass, lightweight metal or even a composite material. In addition, the overall size of the base assembly as compared to the regulation size golf club is significantly smaller while at the same time being structured to facilitate visual observation thereof. Moreover, the orientation of the golf club at various points along the swing path defining the normal golf swing of the user may be efficiently determined.

More specifically, the base assembly comprises a housing having an at least partially hollow or open interior and two oppositely disposed open ends. As such, the housing is removably disposed on the golf club in substantially enclosing or at least partially surrounding relation to a portion of the shaft which is permitted to pass longitudinally through the housing and both of the open ends. The housing is preferably, but not necessarily, disposed at a location along the length of the shaft between the head of the club and the grip. The removable attachment of the housing to a portion of the shaft is made secure by the cooperative structuring between interior surfaces or other interior portions of the housing and the configuration and dimension of the shaft, including the outer surface thereof.

Another feature of the training aid of the present invention is the provision of a reference assembly comprising at least one but preferably a plurality of elongated legs movably connected to the housing and selectively positionable thereon between a stored position and an operative position. Preferably, the one or more legs of the reference assembly are pivotally, rotationally or otherwise movably connected to the sides of the base assembly so as to extend radially outward there from and from the shaft of the golf club to which the housing is attached.

As will be explained in greater detail hereinafter, the operative position is more specifically defined by one of the plurality of legs of the reference assembly being positioned in an exposed, substantially frontal alignment with the longitudinal axis of the golf club. In this frontally aligned orientation, a user will be able to effectively observe and accurately determine whether or not the golf club is in a proper orientation as it travels along various segments of the swing path. As will also be explained hereinafter, the general orientation of the one frontally aligned leg of the reference assembly will indicate whether the golf club is properly orientated and accordingly whether the golf club is traveling along a "preferred" or maximized swing path best able to accomplish a correct or most efficient striking of the golf ball. Concurrently, the operative positioning of the reference assembly also facilitates the golfer accomplishing a proper grip and/or a proper alignment of the hands relative to the face of the club head.

The twisting or turning of the golf club at one or more points along the swing path is an unfortunate and common occurrence and frequently causes an inaccurate striking of the golf ball with the face of the club head. Such inadvertent angular orientation of the club frequently results in an opening or closing of the club face and a "hooking" or "slicing" of the golf ball when struck. The presence of the training aid on the golf club so as to move therewith, wherein the reference assembly is in the aforementioned operative position, allows the user to accurately determine the orientation of the golf club during various points along the swing path while the golfer is in the process of swinging the club. By way of example, the various segments of the swing path where the reference assembly is readily observable include, but are not limited to, addressing of the ball, the mid portion of the back swing where the arms of the golfer are generally level with the ground surface and prior to the wrist of the golfer being cocked, a down swing or power swing segment of the swing path prior to or concurrently with the club head impacting the ball and at least a some of the follow through portion of the swing path, subsequent to ball impact.

Other structural and operative features of at least one preferred embodiment of the training aid of the present invention include the provision of an indicator structure connected to, integrally formed on or defined by at least a portion of the one reference arm disposed in substantially frontal alignment with the golf club, as set forth above. Such indicator structure may comprise distinctive and easily recognizable coloring, indicia, structural configurations or other characteristics which facilitate observation of the indicator structure and accordingly the orientation of the reference arm to which it is attached, while the club passes through the swing path.

Convenience and versatility of the training aid of the present invention is further enhanced by the selective positioning of the reference assembly, including the one or more reference arms associated therewith into a stored position when the housing is removed from the golf club or alternatively when the base assembly remains on the shaft of the golf club but is not used for purposes of monitoring or evaluating the grip and/or swing path of the golf club. Such stored position comprises one or more reference arms being disposed in a substantially folded, aligned and possibly substantially parallel relation to the housing, as the reference arms extend along the corresponding portion of the length of the shaft of the golf club.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
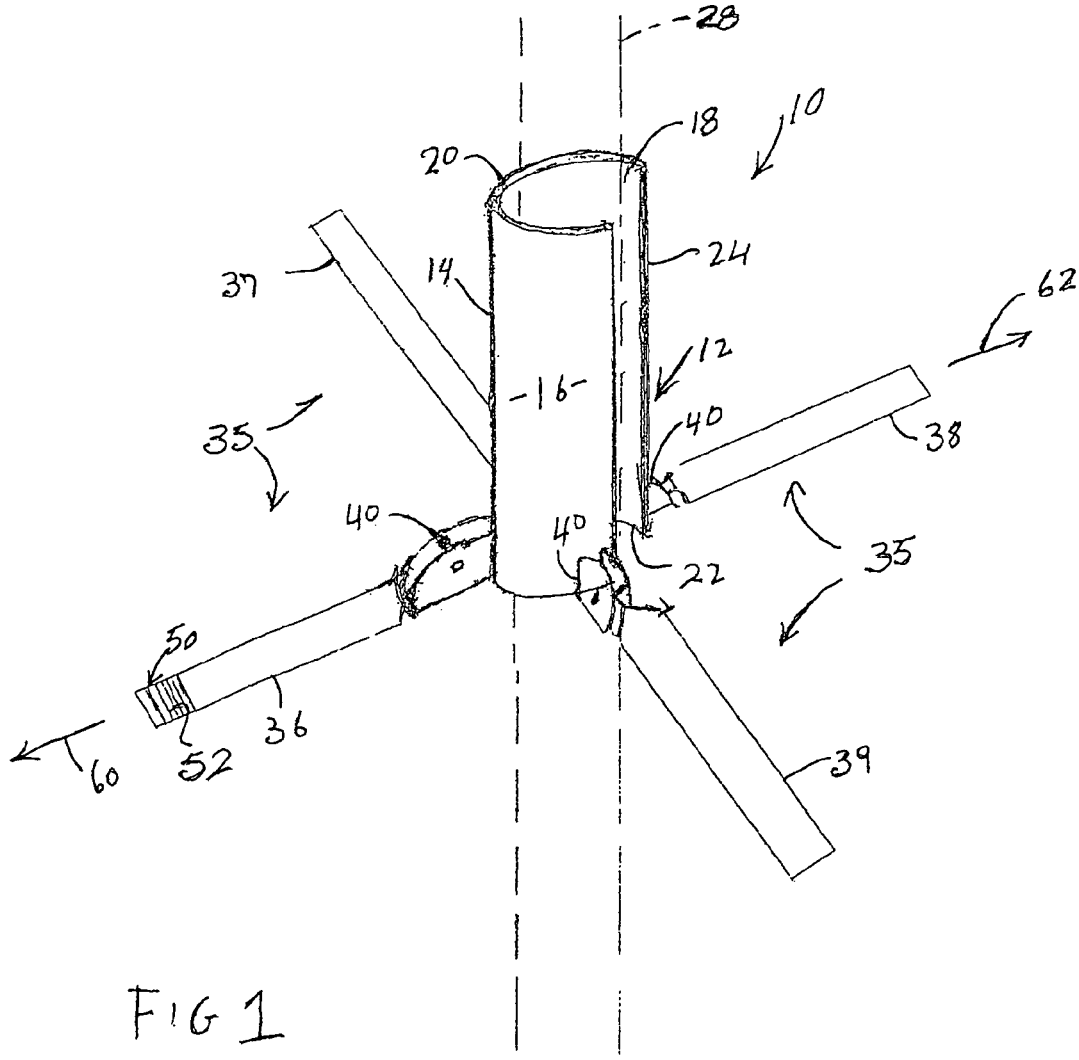
FIG. 1 is a perspective view in partial phantom of one preferred embodiment of the training aid for a golf swing of the present invention.

As shown in the accompanying drawings, the present invention is directed to a training aid generally indicated as 10 which is intended to improve the golf game of a user by means of allowing the individual to review, evaluate and correct his or her grip and golf swing. Accordingly, the training aid of the present invention is dimensioned, configured and structured to be removably connected to or mounted on the golf club so as to travel therewith along a swing path as the participating golfer performs a typical golf swing. As will be evident from a more complete discussion of the structural and operative components of the training aid of the present invention, the cooperative dimensioning and lightweight structure thereof facilitates its removable attachment to the golf club in a manner which will not interfere with the normal golf swing of the participant.

More specifically, the training aid 10 comprises a base assembly generally indicated as 12 which includes a housing 14. In at least one preferred embodiment the housing 14 may have an elongated configuration defined by a continuous side wall 16 surrounding an at least partially hollow interior 18. The housing 14 further includes oppositely disposed open ends 20 and 22 each of which is disposed in communicating relation with the least partially hollow interior 18. In addition, the housing 14 includes an access opening 24 formed in and extending along the length of the sidewall 16 between and in communication with the oppositely disposed open ends 20 and 22. As clearly represented in FIGS. 1 and 2, the access opening 24 also communicates with the at least partially hollow interior 18 and is specifically dimensioned to allow lateral passage of at least a portion of the shaft 28 therethrough. For purposes of clarity, the shaft 28 and a club head 29 are schematically indicated in phantom lines in at least some of the accompanying Figures.

Figure 3:
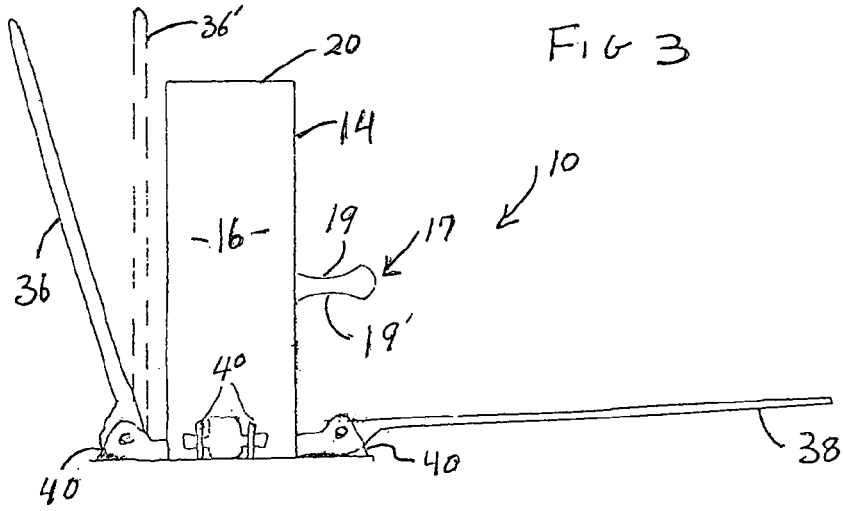
FIG. 3 is a side view of the embodiment of FIGS. 1 and 2 wherein components of the training aid of the present invention are represented in both an operative and stored position.

It is emphasized that the various structural features of the housing 14 may vary at least to the extent of it having a lesser length, such as by being defined by more of a ring-like and/or annular construction than that represented in FIGS. 1 and 3. It is also to be noted that most, if not all, conventional golf clubs comprise a width or transverse dimension of the shaft which is substantially tapered along its length. As such, the portion of the shaft generally closer to the club head is thinner than that portion of the shaft located substantially adjacent to the grip portion of the shaft. Accordingly, regardless of the length of the housing 14, the lateral access opening 24 may be dimensioned to receive at least a thinner portion of the shaft as it passes laterally there through into the at least partially hollow interior 18.

Thereafter, the housing 14 may be repositioned by moving it along the shaft towards the upper, thicker portion of the club closer to the grip thereof. In doing so, a portion of the golf club shaft 28 having a greater transverse dimension will eventually become correspondingly positioned or aligned with the interior surface of the hollow interior 18. When such corresponding position or alignment occurs, a frictional engagement between the exterior surface of the shaft and interior portions of the housing 14 will be established. This frictional engagement will facilitate the stable, but removable, mounting or attachment of the training aid 10 on an appropriately and/or correspondingly sized portion of the shaft 28 during the golf swing. The training aid 10 will thereby be maintained in a predetermined orientation which at least partially may be defined by an operative position thereof as the golf club travels along a swing path defining the golf swing.

Movement or repositioning of the housing 14, as set forth above, as well as the mounting and removal of the training aid 10 relative to the shaft 28 can be facilitated by a handle structure 17 secured to the side 16 and extending outwardly there from. In at least one preferred embodiment represented in FIG. 3, the handle structure 17 includes oppositely facing curved surfaces 19 and 19' which are disposed and configured to facilitate movement of the housing 14 in opposite directions both up and down the shaft 28. As such, the housing 14 can be easily and efficiently mounted on or removed from the shaft 28.

Figure 2:
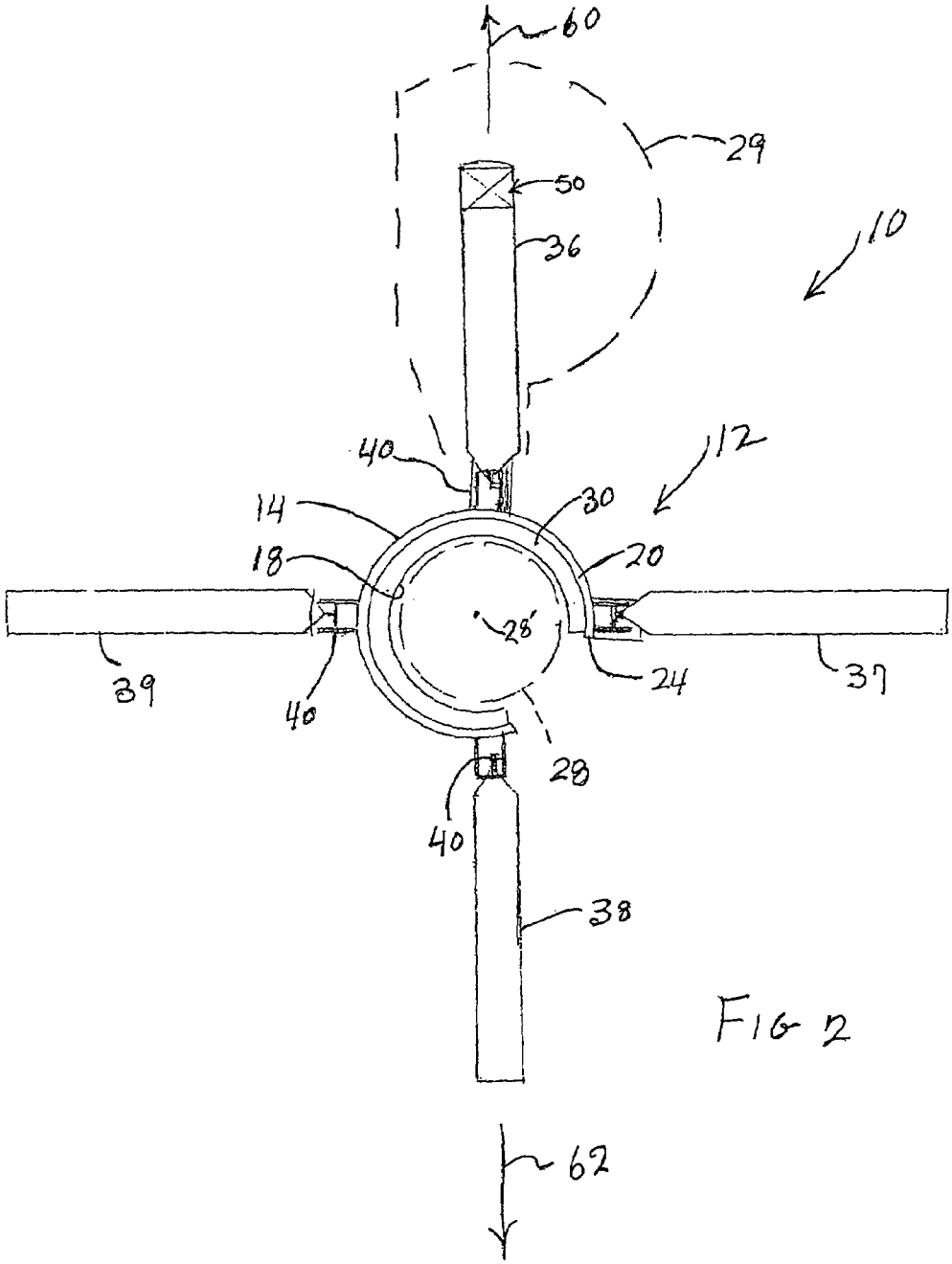
FIG. 2 is a top view, at least partially in phantom, of the embodiment of FIG. 1.

With primary reference to FIG. 2, removal but stable mounting or connection of the base assembly 12 to the exterior of the shaft 28 is further facilitated by a locking assembly 30 which may be connected to, formed on or even defined by the interior surface extending along at least a portion of the hollow interior 18. In at least one preferred embodiment, the locking assembly 30 includes a flexible and/or compressible material. Therefore the locking assembly 30 is forced into the above noted frictional engagement with the exterior of the golf club shaft 28, it will be at least partially compressed and thereby increase its gripping force on the shaft 28. The gripping force exerted on the shaft 28 is enhanced by the fact that the locking assembly 30 as well as the sidewall 16 of the housing 14 is disposed in at least partially surrounding and substantially enclosing relation to the portion of the shaft 28 which it engages. Other embodiments of the locking assembly 30 can be defined by a substantially tapered configuration of the interior surface of the housing 14. As such, the tapered interior surface will eventually and at least partially correspond to an exterior surface of the shaft 28 as a correspondingly dimensioned portion of the shaft 28 is substantially aligned with the interior of the housing 14, as set forth above.

Another feature of the training aid 10 comprises the provision of a reference assembly generally indicated as 35. The reference assembly 35 comprises at least one but preferably a plurality of elongated reference legs 36, 37, 38 and 39. As demonstrated in FIG. 3, each of the legs 36 through 39 are movably interconnected to the housing 14 by means of a cooperatively disposed and structured coupling and/or connecting structures 40. Each of the connecting structures 40 are mounted or otherwise secured to the side 16 of the housing 14 in spaced relation to one another and extend at least partially outward there from. It is to be understood that connecting structures 40 could be located at various points along the length of the housing 14 but in the preferred embodiment of FIGS. 1 and 3 they are collectively disposed adjacent the open end 22.

It should also be noted that each of the coupling or connecting structures 40 may assume a variety of different structures. However, regardless of the specific structural features thereof, the connecting structures 40 are cooperatively functional with an innermost or proximal end, generally indicated as 45, of each of the reference arms 36 through 39 so as to accomplish a pivotal and/or at least partially rotational interconnection between the plurality of reference arms 36 through 39 and the housing 14 to which the connecting structures 40 are mounted. Therefore, the pivotal or otherwise movable interconnection of each of the plurality of reference arms 36 through 39 allows the selective positioning thereof into either an operative position or a stored position. With reference to FIGS. 1 and 3, the operative position is defined by at least one of the reference arms 36. However, the operative position further comprises preferably all of the arms 36 through 39, extending radially outward from the base assembly 12 and specifically the housing 14 and the shaft 28 of the golf club when it is disposed on the interior of the housing 14.

In contrast, when the training aid 10 is not being used for its intended purpose and whether or not it is mounted on the shaft 28 of the golf club, each of the reference arms 36 through 39 may be independently positioned in a stored position as represented by the reference arm 36 and/or 36' in FIG. 3. Such stored position may be more specifically defined by one or more of the reference arms 36 through 39 being disposed substantially adjacent to and at least partially aligned with the length of the housing 14 so as to extend outwardly from the platform 42 in a substantially common direction as the housing 14. As further indicated in FIG. 3, the precise orientation of the one or more reference arms when in the stored position may vary and be represented by the orientation of the reference arm 36, as represented in solid lines and/or the orientation of the reference arm 36' represented in phantom lines. In any event, the stored position is not necessarily meant to be defined by a precise parallel orientation of the one or more reference arms 36 through 39 with the length of the central longitudinal axis of the housing 14.

Figure 4:
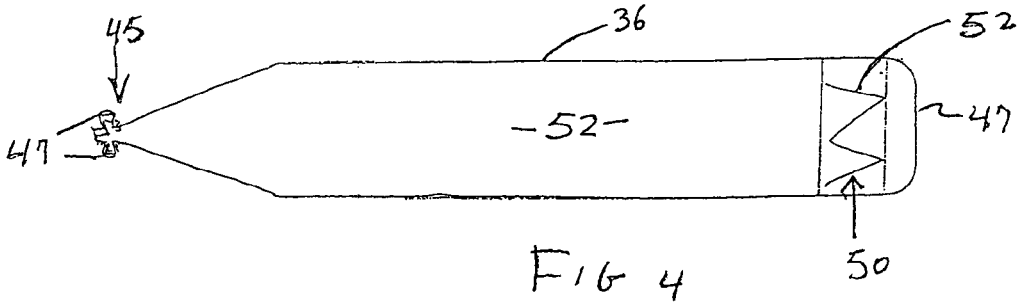
FIG. 4 is a top detailed view of a reference arm associated with the embodiments of FIGS. 1 through 3.
Figure 5:
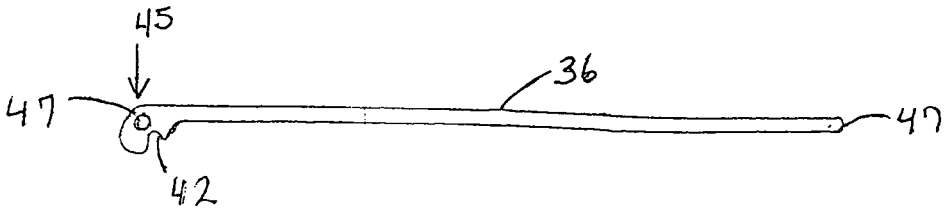
FIG. 5 is a side detailed view of the embodiment of FIG. 4.

With primary reference to FIGS. 4 and 5, the size, configuration and structure of each of the plurality of reference arms 36 through 39 are demonstrated by a detailed representation of a single one of the plurality of reference arms, as at 36. Accordingly, in at least one preferred embodiment each of the reference arms 36 through 39 include the aforementioned proximal end 45 having outwardly extending fingers or trunnions, as at 47. The trunnions 47 are cooperatively disposed, dimensioned and configured to facilitate the aforementioned pivotal or at least partially rotational connection of each of the reference arms 36 through 39 as they are connected to a corresponding one of the coupling or connecting structures 40. Further, each of the reference arms 36 through 39 may have an increased transverse dimension or width along a length thereof.

As also demonstrated in FIG. 5, the proximal end 45 of each of the reference arms 36-39 include a catch structure 42, preferably defined by a cut-out or notched portion. Moreover, the notched catch 42 is disposed and structured to removably engage a portion of the corresponding connector structure 40 (not shown for purposes of clarity) in a manner which serves to retain the respective arms 36-39 in the outwardly extended operative position. Selective positioning of the reference arms into the stored position represented in phantom lines of FIG. 3 is easily and quickly accomplished by disengagement of the catch 42 with the inner or other part of the corresponding connector structure 40.

Also, at least one of the plurality of reference arms 36 through 39, as at 36, may include an indicator structure 50 formed on an exposed surface 52 thereof. As such, the indicator structure 50 is readily observable by the golfer when the training aid 10 is mounted on the shaft 28 and the reference assembly, including one or more of the reference arms 36 through 39, extends radially outward there from in the operative position. The indicator structure 50 may include distinctive coloring, indicia, markings or other structural features, collectively represented as 52, which facilitate its visual observation and location as the training aid 10 travels along the swing path defining the golf swing of the golfer.

As set forth above, the operative features of the training aid 10 allow a golfer to review, evaluate and subsequently attempt to correct imperfections in the location of the hands relative to the face of the club as well as at least a substantial portion of the golf swing. This is primarily accomplished by allowing the golfer to observe the orientation of his or her hands when gripping the club and the orientation of the golf club, including the shaft 28 and the head portion 29 as schematically represented in FIG. 2, during various segments of the swing path defining the golf swing. More specifically, when operatively disposed on the shaft 28, in the manner described above, the housing 14 and the reference assembly 35 is arranged such that at least one of the plurality of reference arms 36 is disposed in an operative position and is further disposed in substantially "frontal alignment" with the length of the shaft 28 and more specifically the central longitudinal axis thereof as schematically indicated as 28'. The frontal alignment is further indicated by the reference arm 36 extending radially outward from the housing 14 and the shaft 28 in overlying relation to the club head 29 and in "front" of the golfer, such as when the golfer grips the club and addresses a golf ball, as schematically indicated by directional arrow 60. For purposes of further reference, the orientation or position of the golfer is substantially "behind" the club head 29 and the shaft 28, such as when the golfer is addressing the golf ball, as schematically indicated by directional arrow 62.

Therefore, when the golfer properly addresses the club, the one reference arm 36, as well as the indicator structure 50 will be disposed as generally and schematically indicated in FIG. 2 such that the reference arm 36 is disposed in frontal alignment with the golf club, including the head 29 and the shaft 28. As the golfer progresses through the various segments of the golf swing, the training aid will travel with the shaft. Further, at various portions or segments of the swing path, the golfer will be able to observe and determine whether the shaft 28, as well as the club head 29, is properly oriented by observing the one reference arm 36 which is facilitated by the positioning and structuring of the indicator structure 50. By way of example, during the address of the ball, a proper alignment between the golf club and the ball will be represented substantially as demonstrated in FIG. 2. During at least a portion of the back swing, proper orientation of the golf club should be indicated by the proper angular orientation of the one reference arm 36 which can be more easily observed by viewing the indicator structure 50. If the reference arm 36 is at a skewed or otherwise excessive angular orientation rather than being substantially vertical when the golf club and training aid 10 are disposed midway through the back swing, the golfer is informed that the golf club is improperly oriented such as by being inadvertently turned or twisted. Similarly, during the down swing or concurrent with the club head 29 impacting the ball, the indicator arm 36 should preferably be in the orientation represented in FIG. 2. If oriented in a significantly different angular orientation, the golfer will thereby be informed that the face of the club head 29 is either opened or closed resulting in either a hook or a slice. Similarly, at an appropriate portion of the follow through the one reference arm 36 as well as the indicator structure 50 can additionally be observed to assure that the club is properly oriented during the follow through segment of the swing path, as the golfer completes the golf swing.

Accordingly, visual observation of the training aid 10 and in particular the one reference arm 36 as the club is gripped and during various segments of the swing path defining the golf swing 10 will indicate whether or not the golfer hands are properly oriented; whether the shaft 28 is inadvertently turned or twisted and/or whether or not the club head 29 is in a proper and preferred orientation immediately prior to or concurrently with it impacting the golf ball. Appropriate correction of the one or more portions of the swing path and the overall golf swing can thereby be effected by the golfer.

As set forth above, the reference assembly 35 may include at least one but preferably a plurality of reference arms 36 through 39. When each of the reference arms 36 through 39 are in the operative position defined by the radially outward extension thereof as demonstrated in FIGS. 1 and 2, the golfer may be more efficiently able to observe various segments or portions of the swing path of the golf club by being exposed to the plurality of reference arms 36 through 39, each of which are extending radially outward from the housing 14 and platform 42, while being in spaced relation to one another.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A training aid structured to indicate a preferred swing path of a golf club, said training aid comprising:

a base assembly including a housing removably connected to a shaft portion of the golf club and movable therewith through the swing path, a reference assembly comprising a plurality of legs movably connected to said housing and positionable between a stored position and an operative position, said plurality of legs extending radially outward from said housing in spaced relation to one another when said reference assembly is in said operative position, at least one of said plurality of legs comprising an indicator structure disposed to assume a plurality of indicative orientations along the swing path when said reference assembly is in said operative position, and said operative position further comprising said one leg disposed in an exposed, frontal alignment with a longitudinal axis of the golf club.

2. A training aid as recited in claim 1 wherein said housing comprises an elongated, open ended configuration disposable in at least partially enclosing relation to an intermediate length of a golf club.

3. A training aid as recited in claim 2 further comprising an access opening disposed and dimensioned to allow lateral passage of the golf club through said access opening and into an interior of said housing.

4. A training aid as recited in claim 2 further comprising a locking assembly disposed on an interior of said housing and structured to secure said housing to a shaft portion of the golf club while the golf club passes along the swing path.

5. A training aid as recited in claim 1 wherein said stored position comprises said plurality of legs disposed in substantially adjacent, spaced and at least partially aligned relation to said housing.

* * * * *

UNITED STATES PATENT AND TRADEMARK OFFICE

CERTIFICATE OF CORRECTION

PATENT NO. : 7,258,622 B1
APPLICATION NO. : 11/049308
DATED : August 21, 2007
INVENTOR(S) : Jamie Gaviria It is certified that error appears in the above-identified patent and that said Letters Patent is hereby corrected as shown below:

Title Page

Item (73) Assignee

"Sof Golf, Inc.," should read --SDF Golf, Inc.,--

Signed and Sealed this

First Day of April, 2008

JON W. DUDAS
*Director of the United States Patent and Trademark Office*